United States Patent [19]

Osborne

[11] 4,206,512

[45] Jun. 10, 1980

[54] LIMITED MOBILITY SLEEPING BAG

[76] Inventor: Robert D. Osborne, Box 377, Rural Retreat, Va. 24368

[21] Appl. No.: 17,354

[22] Filed: Mar. 5, 1979

[51] Int. Cl.[2] ..... A47G 9/00

[52] U.S. Cl. ..... 2/69.5; 5/413; 128/134

[58] Field of Search ..... 5/413, 416, 417, 419, 5/414; 2/69.5, 83; 128/133, 134; 24/201 HE

[56] References Cited

U.S. PATENT DOCUMENTS 3,911,512 10/1975 Plate ..... 5/465
4,125,910 11/1978 Nicholai ..... 2/69.5

FOREIGN PATENT DOCUMENTS 7600862 8/1976 Netherlands ..... 2/69.5
1424516 2/1976 United Kingdom ..... 5/416

*Primary Examiner*—Alexander Grosz

[57] ABSTRACT

A sleeping bag comprising a body portion, leg portions, and two sleeve members, first attachment structure fixed to the body portion, and second attachment structure fixed to a first of the sleeve members, the first and second attachment structures being releasably connectable to permit connection of the first sleeve member to the body portion, the first sleeve member having an opening in a free end thereof adapted to receive a free end of a second of the sleeve members, third attachment structure disposed on the interior of the first sleeve member, and fourth attachment structure disposed on the exterior of a second of the sleeve members, the third and fourth attachment structures being releasably connectable.

4 Claims, 3 Drawing Figures

LIMITED MOBILITY SLEEPING BAG

BACKGROUND OF THE INVENTION

1. Field of the Invention

This invention relates to sleeping bags and is directed more particularly to a sleeping bag permitting limited mobility while in use.

2. Description of the Prior Art

While sleeping bags generally are well-known in the art, there is a need for such a device as will permit a limited degree of mobility while in use. Thus, one using the sleeping bag of the present invention would be able to perform tasks without having to remove himself from the bag.

SUMMARY OF THE INVENTION

It is, therefore, an object of the present invention to provide a sleeping bag which facilitates limited mobility by the user while the bag is in use.

With the above and other objects in view, as will hereinafter appear, a feature of the present invention is the provision of a sleeping bag comprising a body portion, leg portions, and two sleeve members, first attachment means fixed to the body portion, and second attachment means fixed to a first of the sleeve members, the first and second attachment means being releasably connectable to permit connection of the first sleeve member to the body portion, the first sleeve member having an opening in a free end thereof adapted to receive the free end of a second of the sleeve members.

In accordance with a further feature of the invention there is provided a third attachment means disposed on the interior of the first sleeve member and fourth attachment means disposed on the exterior of the second sleeve member, the third and fourth attachment means being releasably connectable to permit connection of the second sleeve member to the first sleeve member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompany drawings in which is shown an illustrative embodiment of the invention from which its novel features and advantages will be apparent.

In the drawings.

DESCRIPTION OF THE PREFERRED EMBODIMENT

Figure 1:
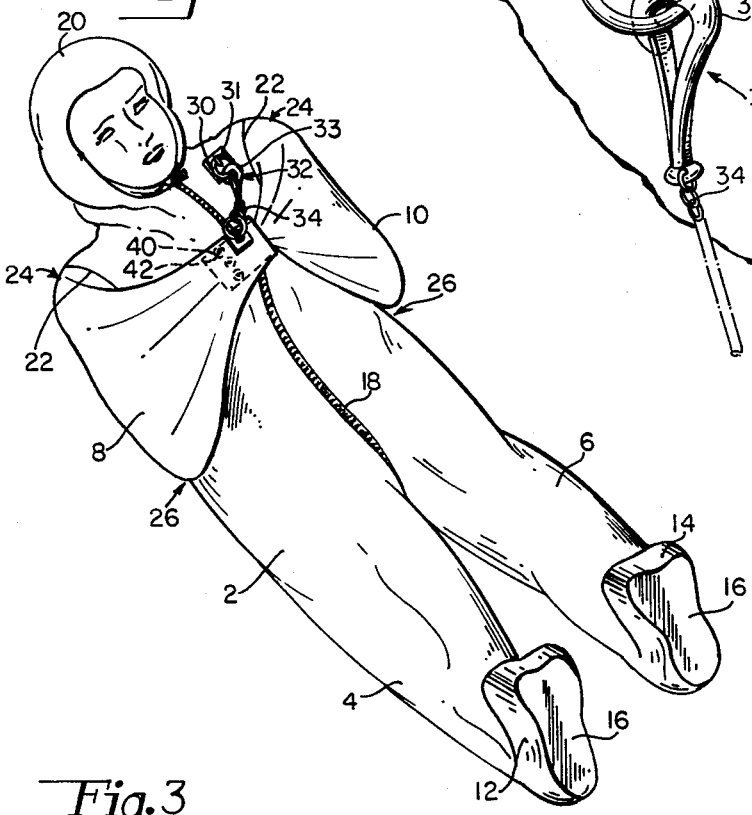
FIG. 1 is a perspective view of one form of limited mobility sleeping bag illustrative of an embodiment of the invention.
Figure 3:
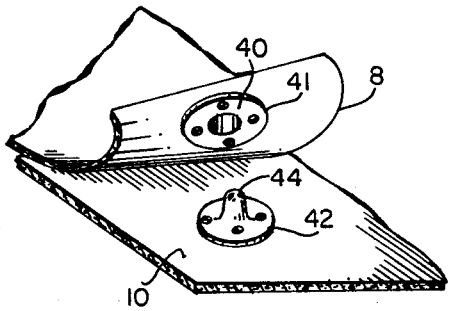
FIG. 3 is an enlarged perspective partial view of a portion of the third and fourth attachment means.

Referring to FIG. 1, it will be seen that the illustrative sleeping bag includes a body portion 2, leg portions 4, 6, and two sleeve members 8, 10. The leg portions 4, 6 have at ends thereof foot portions 12, 14 provided with sole means 16. The body portion 2 is provided with connecting means, preferably in the form of a zipper 18, for opening and closing the body portion 2 of the bag. Preferably, the bag includes a head portion 20 adapted to fit snuggly about the face of the user.

The sleeve members 8, 10 are connected to the body portion 2 at a juncture 22 extending from an area 24 proximate a shoulder portion of the body portion to an area 26 proximate a waist portion of the body portion. The junctures 22 of the sleeve members and the body portion define large openings permitting the arms of the user to be inserted in and withdrawn from the sleeve members, as desired.

Figure 2:
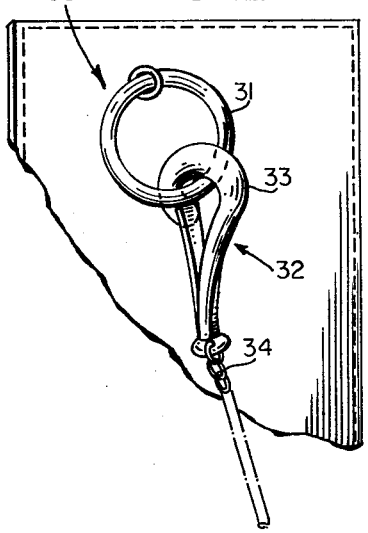
FIG. 2 is an enlarged perspective view of the first and second attachment means.

A first attachment means 30, is fixed to the body portion 2 in a chest area thereof, and preferably is in the form of a snap ring 31 (FIG. 2). A second attachment means 32, preferably in the form of a snap hook 33, or like device, is attached to the sleeve member 8 by means of a flexible cord or chain 34. The snap hook device 33 is adapted to engage the snap ring 31 and, when it is so engaged, to retain the sleeve member 8 more or less in the position shown in FIG. 1.

Third attachment means 40, preferably in the form of snap grommets 41 are disposed on the interior of the first sleeve member 8 and fourth attachment means 42, preferably in the form of snap fittings 44, are disposed on the exterior of the second sleeve member 10, the snap grommets and fittings 41, 44 being releasably connectable to permit connection of the second sleeve member to the interior of the first sleeve member.

In use, an operator opens the bag by way of the zipper 18 and places himself within the bag, one leg of the operator in each of the leg portions of the bag, one arm of the operator in each of the sleeve portions of the bag, and the head of the operator in the head portion of the bag. The zipper 18 is then manually operated to close the bag. At this point the operator's hands extend from free ends of the sleeve members and are free to perform simple tasks. In addition, the configuration of the leg portions of the bag and the provision of sole means 16 permit some ambulatory facility on the part of the operator. When it is desired to secure the bag for sleeping, the operator with his free hand engages the first and second attachment means 30, 32 so as to retain the sleeve 8 in position approximate the chest portion of the bag. The operator may then use his right hand to pull the free end of the left sleeve member 10 into the open end of the right sleeve member. The left arm may be removed from the sleeve 10 to permit easy manipulation of the left sleeve member. The junctures 22 of the sleeves and the body portion are large enough to permit ready removal of an arm from its corresponding sleeve member. With the sleeve member 10 disposed within the open end of the sleeve member 8, the operator may, by using his right hand, engage the snap members 40, 42 which interconnect the sleeve members 8, 10. The operator may then remove his right hand from the sleeve and position it as desired within the body of the bag.

Thus, while it is anticipated that the structure of the bag will be somewhat bulky and therefore such as to limit the movements of a user, it will, nevertheless, permit a certain limited amount of movement by a user without his having to vacate the bag.

It is to be understood that the present invention is by no means limited to the particular construction herein disclosed and/or shown in the drawings, but also comprises any modification or equivalents within the scope of the disclosure.

Having thus described my invention what I claim as new and desire to secure by Letters Patent of the United States is:

1. A sleeping bag comprising a body portion, leg portions, and two sleeve members, said sleeve members being connected to said body portion at a juncture extending from an area proximate a shoulder portion of said body portion to an area proximate a waist portion of said body portion, first attachment means fixed to said body portion, second attachment means fixed to a first of said sleeve members, third attachment means disposed on the interior of said first sleeve member, and fourth attachment means disposed on the exterior of a second of said sleeve members, said first and second attachment means comprising a hook means and snap ring arrangement releasably connectable to permit connection of said first sleeve member to said body portion, said first sleeve member having an opening in a free end thereof adapted to receive a free end of said second sleeve members, said third and fourth attachment means being releasably connectable to permit connection of said second sleeve member to said first sleeve member.

2. The invention according to claim 7, in which said bag further comprises a head portion.

3. The invention according to claim 7, in which said third and fourth attachment means comprise grommets and snap fittings.

4. The invention according to claim 1, in which said leg portions comprising first and second leg portions, each having a foot portion at an end thereof, each foot portion having sole means on a bottom portion thereof.

* * * * *

UNITED STATES PATENT AND TRADEMARK OFFICE

CERTIFICATE OF CORRECTION

PATENT NO. : 4,206,512

DATED : June 10, 1980

INVENTOR(S) : Robert D. Osborne

It is certified that error appears in the above-identified patent and that said Letters Patent are hereby corrected as shown below:

Column 4, line 8, change "7" to -- 1 --.

Column 4, line 10, change "7" to -- 1 --.

Signed and Sealed this

*Second* Day of *September 1980*

[SEAL]

*Attest:*

SIDNEY A. DIAMOND

*Attesting Officer*

*Commissioner of Patents and Trademarks*